US006806692B2

(12) United States Patent
Lee

(10) Patent No.: US 6,806,692 B2
(45) Date of Patent: Oct. 19, 2004

(54) VOLTAGE DOWN CONVERTER

(75) Inventor: Stephen Lee, Santa Clara, CA (US)

(73) Assignee: Giga Semiconductor, Inc., Santa Clara, CA (US)

( * ) Notice: Subject to any disclaimer, the term of this patent is extended or adjusted under 35 U.S.C. 154(b) by 34 days.

(21) Appl. No.: 10/303,107

(22) Filed: Nov. 22, 2002

(65) Prior Publication Data

US 2004/0100235 A1 May 27, 2004

(51) Int. Cl.[7] ..... G05F 1/573
(52) U.S. Cl. ..... 323/277; 323/282
(58) Field of Search ..... 323/282, 283, 323/285, 351, 223, 224, 266, 271, 277, 281; 327/540, 541, 535, 533, 206, 536

(56) References Cited

U.S. PATENT DOCUMENTS 4,395,675 A * 7/1983 Toumani ..... 323/271
5,959,442 A * 9/1999 Hallberg et al. ..... 323/282
6,680,656 B2 * 1/2004 Chen ..... 331/143

OTHER PUBLICATIONS

Gerrit W. Den Besten, et al.; Embedded 5 V–to–3.3 V Voltage Regulator for Supplying Digital IC's in 3.3 V CMOS Technology, IEEE Journal of Solid–State Circuits, vol. 33, No. 7, Jul. 1998; pp. 956–962.

Tsukasa Ooishi, et al.; A Mixed–Mode Voltage Down Converter with Impedance Adjustment Circuitry for Low–Voltage High–Frequency Memories; IEEE Journal of Solid–State Circuits, vol. 31, No. 4, Apr. 1996, pp. 575–585.

Robert J. Widlar; New Developments in IC Voltage Regulators; IEEE Journal of Solid–State Circuits, vol. SC–6, No. 1, Feb. 1971; pp. 2–7.

* cited by examiner

*Primary Examiner*—Rajnikant B Patel
(74) *Attorney, Agent, or Firm*—Gray Cary Ware & Friedenrich LLP

(57) ABSTRACT

A voltage down converter 10 for providing a supply voltage and current to a device, such as a semiconductor device. The voltage down converter includes a first circuit 12 that supplies steady state or "DC" current to the device, and a second circuit 14 that supplies the fluctuating or "AC" current to the device. The first circuit 12 includes a first comparator 18 that drives a first transistor P1 to supply most of the steady state current. The second circuit 14 includes a second comparator 20, which is larger than the first comparator 18, and which drives a second transistor P2, which is smaller than the first transistor P1, to supply the fluctuating current to the device. The converter 10 further includes a feedback circuit 16 for controlling the supply voltage.

8 Claims, 3 Drawing Sheets

VOLTAGE DOWN CONVERTER

FIELD OF THE INVENTION

This invention generally relates to a voltage down converter and more particularly, to an improved voltage down converter that provides a supply voltage and current to a device, and that utilizes a pair of circuits to supply steady state current and fluctuating current to the device with minimal voltage variation and improved stability relative to prior voltage down converters.

BACKGROUND OF THE INVENTION

Voltage down converters or "VDCs" are used to lower the level of an external power supply voltage (e.g., Vcc) provided to a semiconductor device to a desired internal power supply voltage (e.g., Vdd). For example, in a semiconductor device, a voltage down converter may lower an external power supply voltage to the level of an internal power supply voltage, so that each component element within the device may be operated with the internal power supply voltage to secure sufficient reliability of each component element.

FIGS. 1A–C illustrate a conventional voltage down converter ("VDC") in accordance with the prior art. In existing chip designs, a VDC may be used in various applications to supply large amount of "AC" type current (e.g., alternating or fluctuating current) while concomitantly sustaining necessary "DC" type current (e.g.; a fixed current) and a steady DC voltage level. Examples of semiconductor devices that utilize VDCs are SRAM and DRAM devices. The conventional VDC design has some drawbacks when employed in modern applications, which often require large, fluctuating output currents. To provide a large current, the VDC will typically require a relatively large source follower transistor P1, as shown in FIG. 1C. In order to drive the large transistor P1, the comparator C has to be relatively powerful. The relatively large transistor and comparator size results in substantial and undesirable current consumption for the VDC. Also, the feedback or coupling capacitor, Pcc, has to be relatively large in size to stabilize the VDC. The voltage divider formed by resistors R1, R2 is used to provide a desired device or supply voltage (Vdd). In the embodiment of FIGS. 1A–C, the values of the resistors R1 and R2, the device voltage, Vdd, reference voltage, Vref, and feedback loop voltage, Vfb, are related as follows:

$Vref=Vfb+Voffset$ (where $Voffset$ is the input offset voltage of the OPAMP)

$$Vfb=(Vdd*R2)/(R1+R2)$$

$$Vdd=(Vref-Voffset)*(R1+R2)/R2$$

The power to performance ratio of this type of prior VDC diminishes with increasing current supply requirements. In the presence of increasing current demands, the conventional VDC eventually becomes sluggish to supply adequate AC current for digital circuits. When such a scenario occurs, the VDC cannot maintain the output voltage Vdd at a steady level and voltage level dipping occurs. In an SRAM or a DRAM chip, a large dip in voltage level can cause memory cells to fail.

There is therefore a need for a new and improved voltage down converter for use with semiconductor devices, which can provide relatively large output currents and voltages, which minimizes voltage variations during operation, and which has improved stability and robustness.

SUMMARY OF THE INVENTION

One non-limiting advantage of the invention is that it provides an improved voltage down converter for use with semiconductor devices, such as SRAM and DRAM devices.

Another non-limiting advantage of the invention is that it provides a voltage down converter that utilizes a "DC" circuit portion that provides a relatively large steady state output current, and an "AC" circuit portion that provides and controls relatively small output current fluctuations. The AC and DC circuit portions cooperate to provide the desired supply voltage and current with minimal voltage variations and improved stability.

Another non-limiting advantage of the invention is that it provides a voltage down converter that utilizes a pair of comparators that collectively consume less power than single comparator designs of the prior art.

Another non-limiting advantage of the invention is that it provides a voltage down converter that can operate under increasing current demands, while minimizing supply voltage variation and having improved stability and robustness.

According to a first aspect of the present invention, a voltage down converter is disclosed for providing a supply voltage and current to a device. The voltage down converter includes a first circuit portion for providing a first current for supplying steady state current to the device; a second circuit portion for providing a second current for supplying fluctuating current to the device; and a third circuit portion for controlling a value of the supply voltage at an output node.

According to a second aspect of the present invention, a circuit for providing a supply voltage and current to a device is disclosed. The circuit includes a first circuit for supplying steady state current to the device, the first circuit including a first comparator having a first output node and a first transistor having a gate coupled to the first output node, thereby allowing the first comparator to drive the first transistor to supply the first current. A second circuit provides fluctuating current to the device, the second circuit including a second comparator, which is larger than the first comparator and which has a second output node, and a second transistor having a gate coupled to the second output node, thereby allowing the second comparator to drive the second transistor to supply the fluctuating current. Finally, a third circuit provides a feedback signal to the first and second comparators for controlling a value the supply voltage.

According to a third aspect of the present invention, a method of providing a supply voltage and current to a device is disclosed. The method includes the steps of: providing a first current for supplying steady state current demands of the device; providing a second current for supplying fluctuating current demands of the device; and controlling a value of the supply voltage at an output node.

These and other features, advantages, and objects of the invention will become apparent by reference to the following specification and by reference to the following drawings.

DETAILED DESCRIPTION OF A PREFERRED EMBODIMENT OF THE INVENTION

Figure 1A:
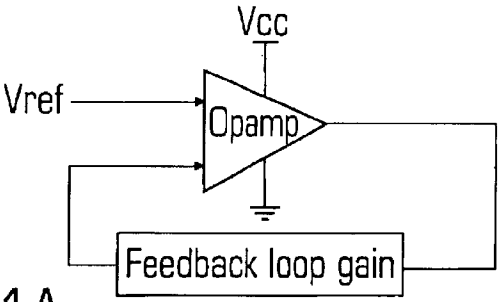
FIG. 1A (PRIOR ART)
FIGS. 1A–C are schematic diagrams of increasing detail illustrating a voltage down converter of the prior art.
Figure 1B:
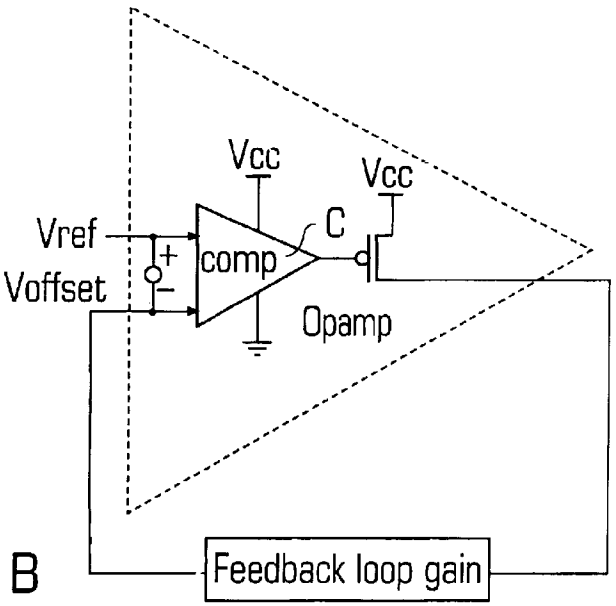
FIG. 1B (PRIOR ART)
Figure 1C:
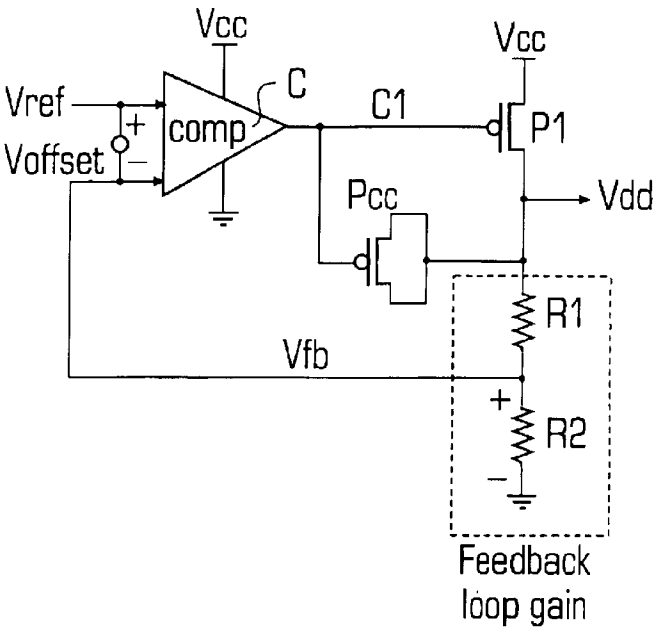
FIG. 1C (PRIOR ART)
Figure 2:
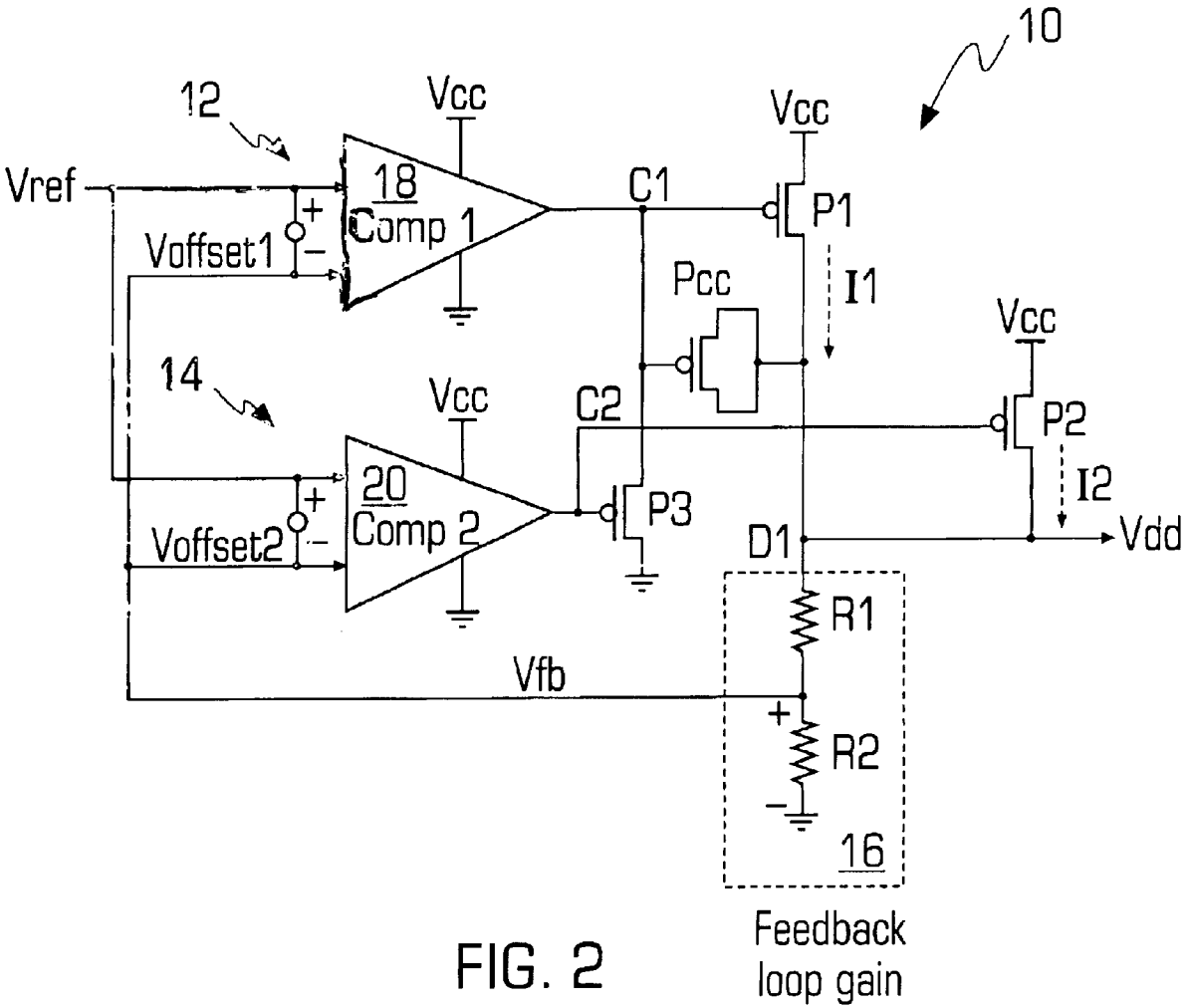
FIG. 2 is a schematic diagram illustrating an embodiment of a voltage down converter according to the present invention.

Referring now to FIG. 2, there is shown a preferred embodiment of a voltage down converter 10 that is made in accordance with the present invention, and that is adapted for use with a semiconductor device. By way of example and without limitation, circuit 10 may be used to provide a supply voltage (e.g., Vdd) and current in a semiconductor memory device, such as an SRAM or a DRAM device.

In the preferred embodiment, voltage down converter 10 is formed from a plurality of conventional circuit components including resistors, comparators and transistors, such as metal-oxide-semiconductor ("MOS") transistors (e.g., p-channel ("PMOS") transistors). It should be appreciated by those skilled in the art that different and/or additional types of suitable transistors and/or other circuit elements may be used to form a voltage down converter within the scope present invention.

In the preferred embodiment, circuit 10 includes three linked circuits or circuit portions 12, 14 and 16 that operate in a cooperative manner to provide the voltage and current supply functions of the present invention. Particularly, circuit 10 includes a steady state or "DC" circuit or portion 12, which is effective to selectively provide a relatively large steady state output current (11); an alternating current or "AC" circuit or portion, which is effective to selectively provide a fluctuating current (12) to satisfy changes in the current demands of the device; and a feedback loop and gain portion 16, which is effective to provide and control the value of the supply voltage (Vdd).

Circuit 12 includes a relatively small comparator 18, a relatively large PMOS transistor P1, and a feedback compensation or coupling capacitor Pcc. Comparator 18 receives two inputs, a reference voltage (Vref) input and feedback loop input (Vfb). Comparator 18 is also coupled to Vcc and ground in a conventional manner, as shown in FIG. 2. The output of the comparator 18 (e.g., node C1) is coupled to the gate of transistor P1, to the feedback or coupling capacitor Pcc, and to the source of PMOS transistor P3. The source of transistor P1 is coupled to Vcc and the drain of transistor P1 is coupled to the output node D1 of the voltage down converter, which is also coupled to the feedback loop gain circuit 16 and the drain of transistor P2. As is well known in>the art, the "source" and "drain" of the transistors described herein may be interchanged based on the type of MOS technology used. In a preferred embodiment, the coupling or feedback capacitor Pcc is formed by use of a PMOS transistor (e.g., by connecting together the source and drain of the transistor, as shown in FIG. 2). However, in alternate embodiments any suitable capacitive element may be used to form coupling or feedback capacitor Pcc.

Circuit 14 includes a relatively large comparator 20, a relatively small PMOS transistor P2, and a PMOS transistor P3. It should be understood that the size differences discussed relative to circuit elements, such as comparators and transistors, refer to the size, power and related parameters of the circuit elements, as known to those skilled in the art. For example, the terms "size" and "larger"/"smaller" as used herein relative to transistors P1, P2 and P3 will refer to the ability of a transistor to drive current, given certain operating conditions and process technology. Furthermore, when referring to comparators (e.g., comparator 20 being larger than comparator 18), it should be understood that the "larger" comparator 20 is greater in size and power than the smaller comparator 18.

Comparator 20 receives two inputs, a reference voltage (Vref) input and a feedback loop input (Vfb). Comparator 20 is also coupled to Vcc and ground in a conventional manner, as shown in FIG. 2. The output of the comparator 20 (e.g., node C2) is coupled to the gate of transistor P2 and to the gate of transistor P3. The drain of transistor P3 is coupled to ground. The source of transistor P2 is coupled to Vcc and the drain is coupled to VDC output node D1. The output node D1 of voltage down converter 10 is also coupled to the feedback loop gain circuit 16 and to the drain of transistor P1. In this manner, VDC output node D1 receives and supplies currents I1 and I2 and voltage Vdd to a device connected to the converter 10.

The feedback loop gain circuit 16 includes a pair of resistors R1 and R2 connected in series. Resistor R1 is coupled to output node D1, and resistor R2 is coupled to ground. The feedback loop line, which provides the feedback voltage signal Vfb, is connected between resistors R1 and R2. The values for resistors R1 and R2 may be selected in order to provide the desired supply voltage based on the following equations:

$Vref=Vfb+Voffset1$, where $Voffset1$ is the input offset voltage of the comparator 18 (due to the nature of the source follower design, the comparator 18 has a much larger input offset voltage than comparator 20, so $Voffset1>>Voffset2$)

$$Vfb=(Vdd*R2)/(R1+R2)$$

$$Vdd=(Vref-Voffset1)*(R1+R2)/R2$$

If Voffset1=0, then Vref=Vfb, and $$Vdd=Vref*(R1+R2)/R2$$

The size, strength and/or parameters of the comparators, transistors and resistors may be selected in a manner known to those skilled in the art, such that voltage down converter 10 will provide a stable, desired output supply voltage Vdd and current, based on the specific circuit application. Additionally, those skilled in the art will appreciate that additional and/or different circuit components could be added to voltage down converter 10 to provide additional and/or different functionality without deviating from the spirit and scope of the invention.

The voltage down converter 10 provides a stable device supply voltage Vdd with improved performance relative to prior VDCs. Although the voltage down converter 10 includes two comparators instead of one comparator, the total power consumption of two comparators may be equal to or less than that of a single comparator in a prior art VDC. The voltage down converter 10 also employs two source follower transistors, P1 and P2. In the preferred embodiment, the total size of P1 and P2 is comparable to the size of the single source follower transistor used in a conventional VDC. The transistor P3 does not supply current but is used to improve the performance of new VDC (e.g., binding circuit portions 12 and 14 together). The concept of the improved voltage down converter 10 is to use a smaller comparator (e.g., comparator 18) to drive a large transistor P1 primarily for steady state or DC current demands, and a large comparator (e.g., comparator 20) to drive a smaller transistor P2 for fluctuating or AC current demands. The smaller comparator 18 preferably has a relatively low voltage gain, a relatively slow output slew rate, and a good phase margin. The larger comparator 20 has a larger voltage gain and a relatively fast output slew rate, but a poorer phase margin. The voltage down converter 10 has improved current supply capability, which means a voltage dip is less likely to occur.

In operation, when a device demands relatively large amounts of current from the voltage down converter 10, the feedback voltage Vfb dips below the reference voltage Vref slightly. The large comparator 20 is quick to respond to compensate for this different by generating an output signal at node C2 (i.e., the output node of comparator 20). The output signal at node C2 causes the relatively small transistor P2 to activate and to start providing current immediately. Concomitantly, the transistor P3 as well as the coupling capacitor Pcc are effective to assist comparator 18 in pulling down the node C1 (e.g., in order to activate transistor P1). Thus, following the activation of transistor P2, transistor P1 begins to provide the bulk amount of the current and comparator 18 slowly takes control of transistor P1. With both transistors P1 and P2 providing current, the feedback voltage Vfb returns to a voltage level that is relatively close to Vref. As a result, comparator 20 reacts quickly to shut off transistor P3. During such time, comparator 18 takes full control of driving transistor P1 to provide steady current (e.g., DC type current) to the circuits.

Both comparators 18 and 20 compliment each other to provide the improved characteristics of the voltage down converter 10. The large comparator 20 responds fast and is generally active only for short periods of time to provide relatively small amounts of fluctuating or AC current by selectively activating transistor P2, thereby generating current 12. Furthermore, by selectively activating transistor P3, comparator 20 assists comparator 18 in driving transistor P1 (e.g., by pulling down node C1), effective to supply a relatively large or steady state current to the device (i.e., by generating current 11). In contrast, the small comparator 18 responds slowly, thereby sustaining the current drive and maintaining the steady voltage level at all times. Hence, the AC portion 14 of the circuit responds very quickly to satisfy relatively small and rapid fluctuations in output current demands through current 12, while the DC portion 12 of the circuit provides the majority of the relatively large steady state output current demands through current 11. The transistor P3 binds the AC and DC circuit portions 12 and 14 together and assists in activating transistor P1. The feedback compensation capacitor Pcc provides a good phase margin for the converter 10. Therefore, the new voltage down converter 10 is very stable. The actual behavior of the voltage down converter 10 depends on the size and power of comparators 18 and 20, as well as the size of transistors P1, P2 and P3, which may be selected by one skilled in the art based on the particular application and performance desired.

In one embodiment, the size and power of comparator 20 may be about 2 to 4 times that of comparator 18. The size of comparator 18 can be minimized because the bulk of the "work" (e.g., switching) is performed by comparator 20. In the arrangement of voltage down converter 10, comparator 20 is the "workhorse" of the two comparators. The maximum current supply rating of the voltage down converter 10 may be determined by the size of transistor P1. To ensure a good operating margin, the typical current supply is limited to about half of the maximum rating. In one embodiment, the size of transistor P2 may be about one tenth of the size of transistor P1, which means that transistor P2 may supply about one-tenth of the DC current, while transistor P1 may supply about nine-tenths of the DC current demands in a steady state. Transistor P2 provides most of the "AC" current, thereby compensating for fluctuations in the current demands of the associated device. With respect to the fluctuating or AC current demands, transistor P2 is capable of delivering most of the demands because the output swing of comparator 20 may be about twice large than that of comparator 18. In one embodiment, the size of transistor P3 is about half of the size of the size of transistor P2.

In one non-limiting embodiment, a goal of the design is to keep comparator 18 robust. Thus, in such an embodiment, the size of transistors P2 and P3 may be kept small relative to transistor P1. It should be noted, however, that a transistor P3 that is too small might render comparator 20 ineffective. In determining the value or size of the various components, a careful balance between all the elements in the scheme is desirable. The foregoing design suggestions are non-limiting and it should be appreciated that for each design and process technology, the voltage down converter 10 may require fine-tuning, but can be easily adapted.

There are other circuit characteristics that one skilled in are might consider when implementing the voltage down converter 10 in a design. One consideration may include the input offset voltage of voltage down converter 10, as well as the offset of the two comparators. The voltage down converter 10 has inherent voltage offset because of the source follower. The input offset voltages, Voffset1 and Voffset2, of voltage down converter 10 will vary depending on the output currents I1 and I2. The larger of the input offset voltages, Voffset1 and Voffset2, will be based on the larger of I1 and I2 (i.e., if I1 is larger than I2, then Voffset1 will be larger than Voffset2 and vice-versa). In general, Voffset1 is larger than Voffset2 because I1 is generally larger than I2. In SRAM or DRAM applications, the output voltage change of the VDC due to the input offset voltage is relatively small and less critical. However, it is still desirable to carefully select the W and L of devices for comparator design. That is, the two comparators 18 and 20 should use same devices and same device layouts to reduce process variation. Another consideration may be the voltage supply rejection ratio of the voltage down converter. The voltage supply rejection of a VDC means that the VDC maintains a constant output voltage at node D1 while the supply voltage fluctuates. This is desirable because supply voltage may be noisy in a digital design. The voltage supply rejection in a VDC design is determined by the ability of the comparators and the bias circuit of the comparators to reject the supply voltage fluctuation. There are many known comparator and bias circuit designs that deal with this specific concern. A designer may implement an appropriate circuit design to achieve the necessary voltage supply rejection.

Figure 3:
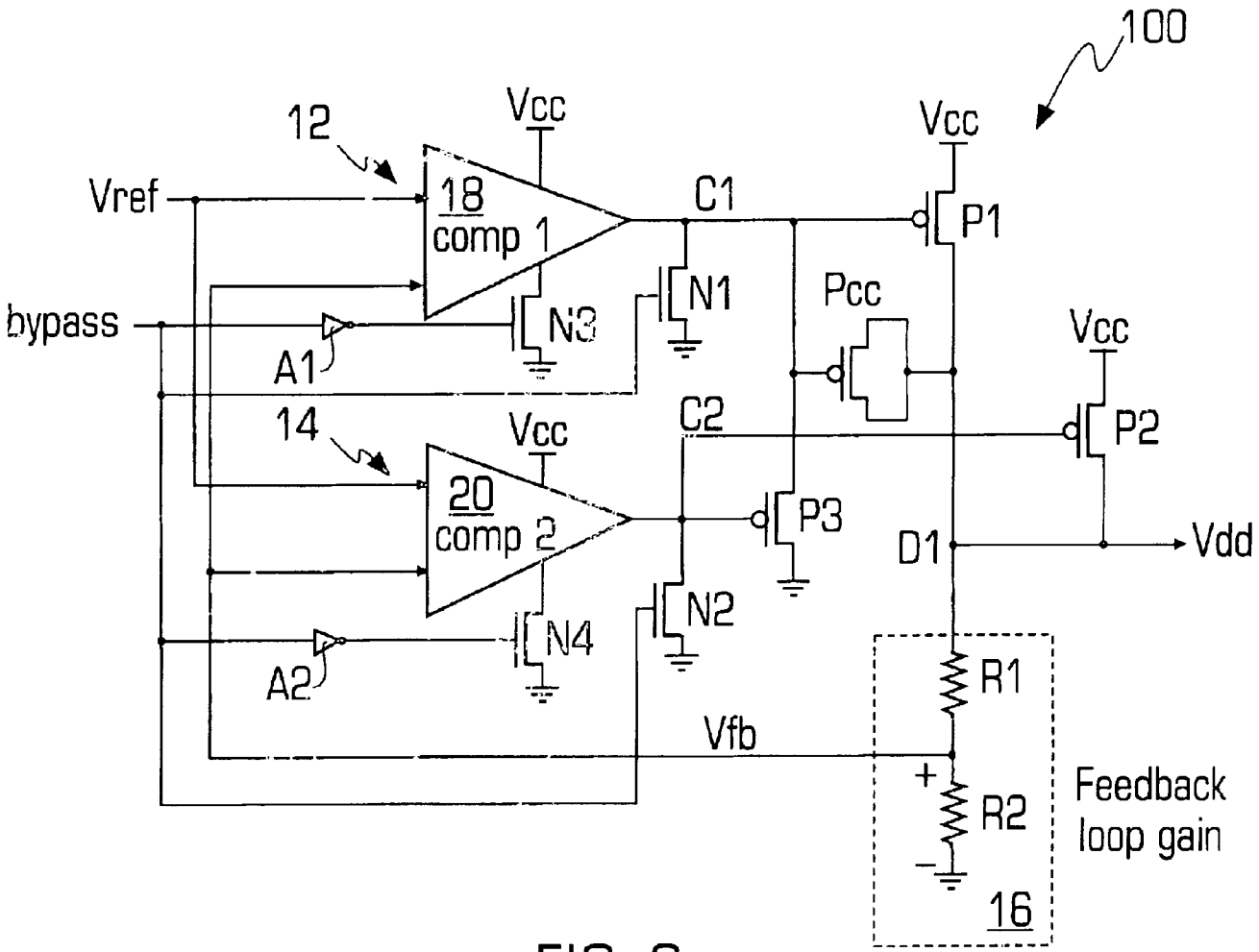
FIG. 3 is a schematic diagram illustrating an embodiment of a voltage down converter including a bypass circuit according to the present invention.

Another consideration is testability. A bypass function may be added to the new voltage down converter to facilitate testing of rest of the circuitry. FIG. 3 illustrates one embodiment of a voltage down converter 100 including a bypass function. Voltage down converter 100 functions in a substantially similar manner as voltage down converter 10, and includes many of the same elements as voltage down converter 10, as indicated by those elements bearing like reference numerals. Voltage down converter 100 further includes a bypass circuit including inverters A1, A2, and NMOS transistors, N1, N2, N3 and N4. Inverters A1, A2 are respectively coupled to the bypass signal line and to the gates of transistors N3, N4. Transistors N1, N2 are coupled to nodes C1 and C2 as shown in FIG. 3 (e.g., the drains of transistors N1, N2 are respectively coupled to nodes C1, C2, the gates are each coupled to the bypass signal line, and the sources are each coupled to ground);. Transistors N3, N4 are coupled to comparators 18 and 20 as shown in FIG. 3 (e.g., the drains of transistors N3, N4 are respectively coupled to comparators 18, 20, the gates are respectively coupled to inverters A1, A2, and the sources are each coupled to ground).

In operation, the bypass circuit may be used to selectively bypass voltage down converter 100 by placing a logic high signal on the bypass signal line. When VDC 100 is bypassed, both comparators are disabled by use of NMOS transistors N3, N4 (which are deactivated by the inverted signals provided by inverters A1, A2). Nodes C1 and C2 are grounded by NMOS transistors N1 and N2, respectively. PMOS transistors P1 and P2 are fully on in the bypass mode. Therefore, the output voltage at node D1 follows the external power supply voltage Vcc. The foregoing bypass function may be desirable in some VDC applications. When a logic low signal is placed on the bypass line, the voltage down converter 100 resumes control and regulates Vdd in a manner substantially identical to that described relative to voltage down converter 10.

It should be understood that the inventions described herein are provided by way of example only and that numerous changes, alterations, modifications, and substitutions may be made without departing from the spirit and scope of the inventions as delineated within the following claims.

What is claimed is:

1. A voltage down converter for providing a supply voltage and current to a device comprising:

a first circuit portion for providing a first current for supplying steady state current to the device;

a second circuit portion for providing a second current for supplying fluctuating current to the device; and a third circuit portion for controlling a value of the supply voltage provided to the device;

wherein the first circuit portion comprises a first comparator that receives a reference voltage input and a feedback input from the third circuit portion, and a first transistor coupled to the first comparator for providing the first current, the first comparator including a first output node that is coupled to a gate of the first transistor, thereby enabling the first comparator to selectively activate the first transistor for generating the first current;

wherein the second circuit portion comprises a second comparator that receives the reference voltage input and the feedback input from the third circuit portion, and a second transistor coupled to the second comparator for providing the second current, the second comparator including a second output node that is coupled to the second transistor, thereby enabling the second comparator to selectively activate the second transistor for generating the second current; and wherein a third transistor is coupled to the first and second output nodes and is effective to assist in activating the first transistor.

2. The voltage down converter of claim 1 wherein the third transistor includes a gate that is coupled to the second output node, a source that is coupled to the first output node and a drain that is coupled to ground.

3. A voltage down converter for providing a supply voltage and current to a device comprising:

a first circuit portion for providing a first current for supplying steady state current to the device;

a second circuit portion for providing a second current for supplying fluctuating current to the device; and a third circuit portion for controlling a value of the supply voltage provided to the device;

wherein the first circuit portion comprises a first comparator that receives a reference voltage input and a feedback input from the third circuit portion, and a first transistor coupled to the first comparator for providing the first current, the first comparator including a first output node that is coupled to a gate of the first transistor, thereby enabling the first comparator to selectively activate the first transistor for generating the first current;

wherein the second circuit portion comprises a second comparator that receives the reference voltage input and the feedback input from the third circuit portion, and a second transistor coupled to the second comparator for providing the second current, the second comparator including a second output node that is coupled to the second transistor, thereby enabling the second comparator to selectively activate the second transistor for generating the second current; and wherein a coupling capacitor is connected between the first output node and a drain of the first transistor.

4. A voltage down converter for providing a supply voltage and current to a device comprising:

a first circuit portion for providing a first current for supplying steady state current to the device;

a second circuit portion for providing a second current for supplying fluctuating current to the device; and a third circuit portion for controlling a value of the supply voltage provided to the device, the third circuit portion including a plurality of resistors and a feedback loop.

5. A voltage down converter for providing a supply voltage and current to a device comprising:

a first circuit portion for providing a first current for supplying steady state current to the device;

a second circuit portion for providing a second current for supplying fluctuating current to the device;

a third circuit portion for controlling a value of the supply voltage provided to the device; and a fourth circuit portion for selectively bypassing the voltage down converter and causing the supply voltage to follow an external power supply voltage.

6. A circuit for providing a supply voltage and current to a device, comprising:

a first circuit for supplying steady state current to the device, including a first comparator having a first output node and a first transistor having a gate coupled to the first output node, the first comparator being adapted to selectively drive the first transistor, thereby supplying the steady state current;

a second circuit for supplying fluctuating current to the device, including a second comparator, which is larger than the first comparator, and which has a second output node, and a second transistor having a gate coupled to the second output node, the second comparator being adapted to selectively drive the second transistor, thereby supplying the fluctuating current;

a third circuit for providing a feedback signal to the first and second comparators for controlling a value of the supply voltage; and a third transistor including a gate which is coupled to the second output node, a source which is coupled to the first output node, and a drain that is coupled to ground, the third transistor being effective to assist in driving the first transistor.

7. A circuit for providing a supply voltage and current to a device, comprising:

a first circuit for supplying steady state current to the device, including a first comparator having a first output node and a first transistor having a gate coupled to the first output node, the first comparator being adapted to selectively drive the first transistor, thereby supplying the steady state current;

a second circuit for supplying fluctuating current to the device, including a second comparator, which is larger than the first comparator, and which has a second output node, and a second transistor having a gate coupled to the second output node, the second comparator being adapted to selectively drive the second transistor, thereby supplying the fluctuating current;

a third circuit for providing a feedback signal to the first and second comparators for controlling a value of the supply voltage; and a coupling capacitor which is connected between the first output node and a drain of the first transistor.

8. A circuit for providing a supply voltage and current to a device, comprising:

a first circuit for supplying steady state current to the device, including a first comparator having a first output node and a first transistor having a gate coupled to the first output node, the first comparator being adapted to selectively drive the first transistor, thereby supplying the steady state current;

a second circuit for supplying fluctuating current to the device, including a second comparator, which is larger than the first comparator, and which has a second output node, and a second transistor having a gate coupled to the second output node, the second comparator being adapted to selectively drive the second transistor, thereby supplying the fluctuating current;

a third circuit for providing a feedback signal to the first and second comparators for controlling a value of the supply voltage; and a bypass circuit which is coupled to the first and second comparators and to the first and second output nodes, and which is adapted to selectively disable the first and second comparators and to selectively drive the first and second output nodes to ground, thereby bypassing the comparators and activating the first and second transistors effective to cause the supply voltage to follow an external power supply voltage.

* * * * *